US007667422B2

(12) United States Patent
Hou

(10) Patent No.: US 7,667,422 B2
(45) Date of Patent: Feb. 23, 2010

(54) FAN WITH FAILURE DETECTING FUNCTION

(75) Inventor: Chuan-Tsai Hou, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/953,867

(22) Filed: Dec. 11, 2007

(65) Prior Publication Data

US 2009/0009038 A1 Jan. 8, 2009

(30) Foreign Application Priority Data

Jul. 2, 2007 (CN) ..... 2007 1 0200981

(51) Int. Cl.
*H02P 7/00* (2006.01)

(52) U.S. Cl. ..... 318/434; 318/139; 318/478; 318/471; 340/648; 340/636.17

(58) Field of Classification Search ..... 318/139, 318/434, 471, 478; 361/23, 24, 30, 31, 91.4; 340/636.17, 648, 662, 664
See application file for complete search history.

(56) References Cited

U.S. PATENT DOCUMENTS

| | | | | |
|---|---|---|---|---|
| 4,142,539 | A * | 3/1979 | Shih et al. | 134/113 |
| 4,262,238 | A * | 4/1981 | Schwarz et al. | 388/811 |
| 4,479,115 | A * | 10/1984 | Holzhauer | 340/611 |
| 4,644,474 | A | 2/1987 | Aposchanski et al. | |
| 4,843,378 | A * | 6/1989 | Kimura | 340/635 |
| 5,889,469 | A * | 3/1999 | Mykytiuk et al. | 340/635 |
| 6,163,266 | A * | 12/2000 | Fasullo et al. | 340/664 |
| 7,057,363 | B2 * | 6/2006 | Ku | 318/268 |
| 2008/0151444 | A1 * | 6/2008 | Upton | 361/31 |

* cited by examiner

*Primary Examiner*—Bentsu Ro
*Assistant Examiner*—Thai Dinh
(74) *Attorney, Agent, or Firm*—Frank R. Niranjan

(57) ABSTRACT

A fan with failure detecting function includes a power input terminal, a current limiting resistor, a light emitting diode (LED), and a fan motor. The power input terminal is coupled to the anode of the LED via the current limiting resistor. The cathode of the LED is coupled to one terminal of the fan motor, another terminal of the fan motor is grounded.

3 Claims, 1 Drawing Sheet

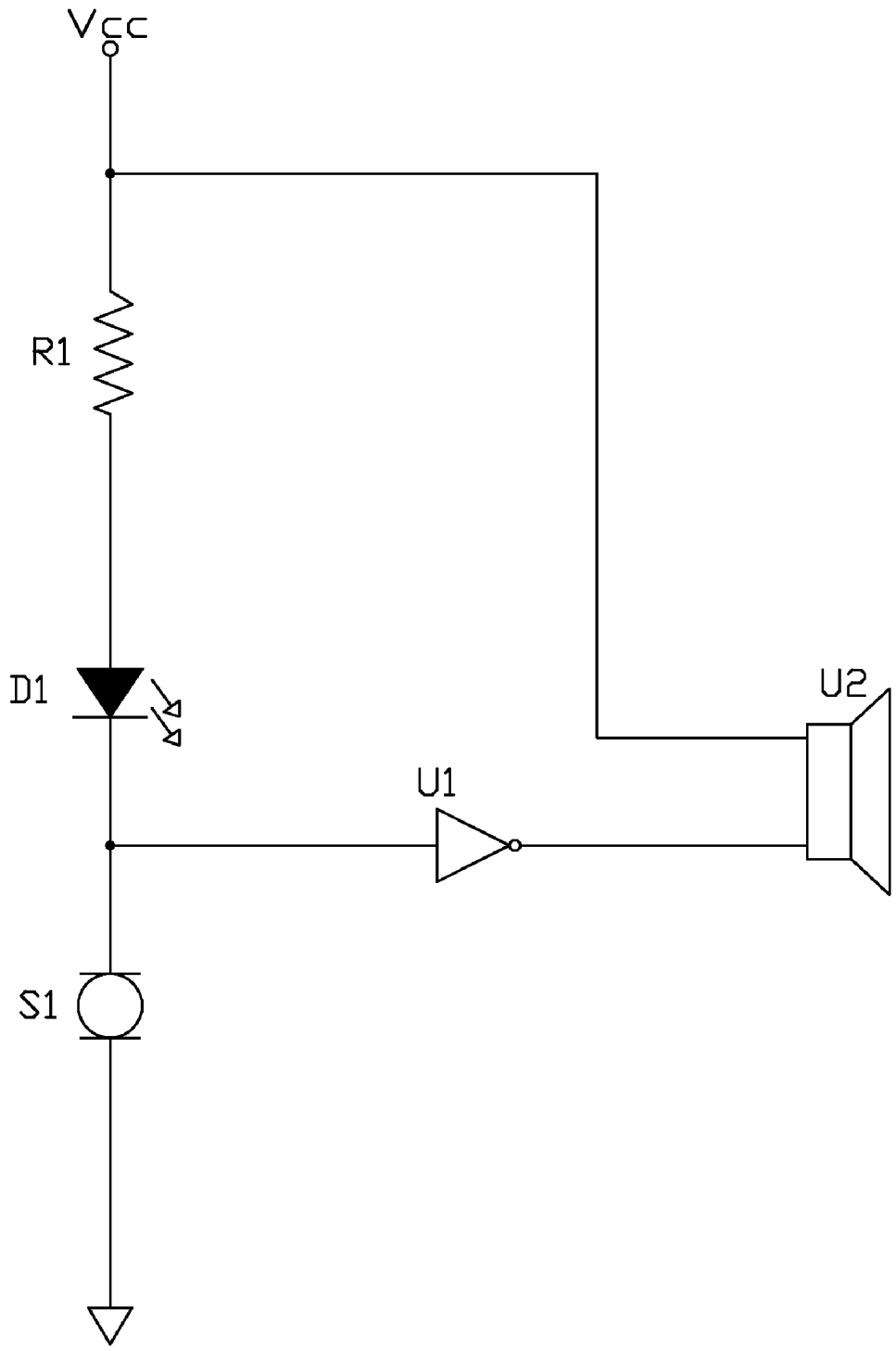
Vcc
R1
D1
U2
U1
S1

FAN WITH FAILURE DETECTING FUNCTION

BACKGROUND

1. Field of the Invention

The present invention relates to fans, and particularly to a fan with a failure detecting function.

2. Description of Related Art

Developments in today's highly information-intensive society have led to remarkable improvements in performances of electronic devices. During operation of many contemporary electronic devices such as central processing units (CPUs), large amounts of heat are produced. Typically, fans are used to facilitate removal of heat in computers. The fans must be running stably, so as to prevent the device from becoming unstable or being damaged. If the fans in the computers run unstably or even cease running, heat generated from the CPUs will not be dissipated on time and will ruin the CPUs.

What is needed, therefore, is to provide a fan with a failure detecting function.

SUMMARY

An exemplary fan with failure detecting function includes a power input terminal, a current limiting resistor, a light emitting diode (LED), and a fan motor. The power input terminal is coupled to the anode of the LED via the current limiting resistor. The cathode of the LED is coupled to one terminal of the fan motor, another terminal of the fan motor is grounded.

Other advantages and novel features of the present invention will become more apparent from the following detailed description of preferred embodiment when taken in conjunction with the accompanying drawing, in which:

BRIEF DESCRIPTION OF THE DRAWING

The drawing is a circuit diagram of an embodiment of a fan with failure detecting function in accordance with the present invention.

DETAILED DESCRIPTION

Referring to the drawing, a fan with a failure detecting function in accordance with an embodiment of the present invention includes a power input terminal Vcc, a current limiting resistor R1, a light emitting diode (LED) D1, a fan motor S1, a NOT gate U1, and a buzzer U2.

In this embodiment, the fan is a two wire fan. The power input terminal Vcc is coupled to a power supply, and is coupled to the anode of the LED D1 via the current limiting resistor R1. The cathode of the LED D1 is coupled to one terminal of the fan motor S1, and is coupled to the input terminal of the NOT gate U1. Another terminal of the fan motor S1 is grounded, and the output terminal of the NOT gate U1 is coupled to one terminal of the buzzer U2. Another terminal of the buzzer U2 is coupled to the power input terminal Vcc.

When the power supply is on and the fan motor operates normally, the power supply provides a direct current (DC) voltage to the LED D1 via the current limiting resistor R1. Then the LED D1 turns on and emits light to indicate the fan motor is working. Voltage at the input terminal of the NOT gate U1 is low level, and voltage at the output terminal of the NOT gate U1 is high level. Another terminal of the buzzer U2 coupled with the power input terminal Vcc is also high level. There is no voltage difference between the two terminals of the buzzer U2, so the buzzer U2 does not alarm.

When the power supply is on but the fan motor stops working, the fan motor S1 is an open circuit, the LED D1 does not emit light to indicate the fan motor stops working. Voltage at the input terminal of the NOT gate U1 is high level, and voltage at the output terminal of the NOT gate U1 is low level. There is a voltage difference between the two terminals of the buzzer U2, so the buzzer U2 alarms to alert users to repair or replace the fan motor.

During operation of the fan with a failure detecting function, the LED D1 emits light and the buzzer U2 does not alarm to indicate the fan motor is working, and the LED D1 turns off and the buzzer U2 alarms to indicate when the fan motor stops working. So the users can repair or replace the fan motor as needed. Therefore damage to the CPUs can be avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan with a failure detecting function, comprising:

a power input terminal coupled to a power supply to receive a voltage from the power supply;

a current limiting resistor with one terminal coupled to the power input terminal;

a light emitting diode (LED) with the anode coupled to another terminal of the current limiting resistor; and a fan motor with one terminal coupled to the cathode of the LED, another terminal of the fan motor being grounded;

wherein the LED is configured for indicating the fan motor working state, when the power supply is on and the fan motor operates normally, the power supply provides a voltage to the LED via the current limiting resistor, the LED turns on and emits light to indicate the fan motor is working, when the power supply is on and the fan motor stops working, the fan motor is in an open circuit, the LED emits no light to indicate the fan motor stops working.

2. The fan as claimed in claim 1, further comprising a NOT gate and a buzzer, the input terminal of the NOT gate is coupled to the cathode of the LED, the output terminal of the NOT gate is coupled to one terminal of the buzzer, another terminal of the buzzer is coupled to the power input terminal.

3. A fan with a failure detecting function, comprising:

a power input terminal coupled to a power supply;

a current limiting resistor with one terminal coupled to the power input terminal;

a light emitting diode (LED) with the anode coupled to another terminal of the current limiting resistor;

a fan motor with one terminal coupled to the cathode of the LED, another terminal of the fan motor being grounded;

a NOT gate with the input terminal coupled to the cathode of the LED; and a buzzer with one terminal coupled to the output terminal of the NOT gate, another terminal coupled to the power input terminal.

* * * * *